US005264144A

United States Patent [19]

Moroney et al.

[11] Patent Number: 5,264,144

[45] Date of Patent: Nov. 23, 1993

[54] FREEZER PERSONAL CLEANSING BAR WITH SELECTED FATTY ACID SOAPS FOR IMPROVED MILDNESS AND GOOD LATHER

[75] Inventors: Natalie M. Moroney, Loveland; James E. Taneri, West Chester; Robert G. Bartolo, Cincinnati; Mark L. Kacher, Mason; Mary E. Carethers, Cincinnati; Lawrence A. Gilbert, West Chester; Dawn M. French, Cincinnati; Gerald L. Cantey, Fairfield, all of Ohio

[73] Assignee: The Procter & Gamble Company, Cincinnati, Ohio

[21] Appl. No.: 707,520

[22] Filed: May 30, 1991

[51] Int. Cl.[5] ..... C11D 9/22; C11D 9/24; C11D 17/00

[52] U.S. Cl. ..... 252/117; 252/121; 252/132; 252/134; 252/174; 252/370

[58] Field of Search ..... 252/132, 134, 174, 117, 252/121, 370

[56] References Cited

U.S. PATENT DOCUMENTS

| | | | |
|---|---|---|---|
| 3,835,058 | 9/1974 | White | 252/121 |
| 4,493,786 | 1/1985 | Joshi | 252/368 |
| 4,557,853 | 12/1985 | Collins | 252/128 |
| 4,946,618 | 8/1990 | Knochel et al. | 252/117 |
| 4,963,284 | 10/1990 | Novakovic et al. | 252/108 |
| 5,204,014 | 4/1993 | Redd et al. | 252/134 |

FOREIGN PATENT DOCUMENTS 350306 1/1990 European Pat. Off. .

*Primary Examiner*—Wayne Langel
*Attorney, Agent, or Firm*—Leonard Williamson

[57] ABSTRACT

The present invention relates to an improved freezer bar soap comprising selected saturated $C_{14}$-$C_{18}$ fatty acid soaps and lathering soap selected from lauric, oleic, and other minor selected more soluble soaps. The bars of this invention have improved mildness while maintaining acceptable lathering/sudsing characteristics.

12 Claims, No Drawings

FREEZER PERSONAL CLEANSING BAR WITH SELECTED FATTY ACID SOAPS FOR IMPROVED MILDNESS AND GOOD LATHER

TECHNICAL FIELD

This invention relates to freezer personal cleansing bar soaps.

BACKGROUND OF THE INVENTION

This invention relates to personal cleansing bar soaps prepared from soap using a "freezer" bar process of the general type disclosed in U.S. Pat. No. 3,835,058, White, issued Sep. 10, 1974, incorporated herein by reference. These bars are called "freezer bars," and White teaches a freezer bar soap process.

Japanese Pat. J5 7030-798, Jul. 30, 1980, discloses transparent solid "framed" or "molded" soap in which fatty acids constituting the soap component are myristic, palmitic, and stearic acids. A transparent soap is described in which at least 90 wt. % of the fatty acids which constitute the soap component are myristic acid, palmitic acid, and stearic acid. The product is reported as a transparent, solid soap having good frothing and solidifying properties, good storage stability, and a low irritant effect on human skin. The process and transparent composition exemplified in Jap. J5 7030-798 are distinguished from nontransparent freezer bars. A freezer bar process is also distinguished from a transparent framed bar process.

SUMMARY OF THE INVENTION

The present invention relates to an improved freezer bar soap comprising selected saturated $C_{14}$–$C_{18}$ fatty acid soaps and lathering soap selected from lauric, oleic, and other minor selected more soluble soaps. The bars of this invention have improved mildness while maintaining acceptable lathering/sudsing characteristics. Freezer bar soaps can be made using a process generally disclosed in U.S. Pat. No. 3,835,058, White, supra.

OBJECT OF THE INVENTION

It is an object of the present invention to provide a mild, good lathering freezer bar soap. Another object is to provide a freezer bar soap that is milder than the current standard good lathering freezer bar soap which is identified below in the Examples as the Comparative Bar.

Yet another object of the present invention is to provide a good lathering freezer bar without impairing mildness.

Still another object is to provide a freezer bar composition which is processable.

Other objects of the present invention will be apparent in the light of the following disclosure.

DETAILED DESCRIPTION OF THE INVENTION

The present invention relates to an improved freezer bar soap comprising selected saturated $C_{14}$–$C_{18}$ fatty acid soaps and lathering soap selected from lauric, oleic, and $C_8$, $C_{10}$, and $C_{18:2}$ soaps. The bars of this invention have improved mildness while maintaining acceptable sudsing characteristics. Freezer bar soaps can be made using a process generally disclosed in U.S. Pat. No. 3,835,058, White, supra. Such bars are highly desirable from the standpoint of skin mildness and processability while maintaining other acceptable bar qualities including good sudsing and/or good smear characteristics.

The present invention is broadly defined as:

A mild, lathering personal cleansing freezer soap bar comprising:

I. saturated fatty acid soaps selected from the group consisting of: myristic, palmitic, and stearic acid soaps and mixtures thereof at a level of from about 50% to about 85% by weight of total fatty acid soap; and II. from about 15% to about 50% of soap selected from the group consisting of: oleic and lauric acid soaps and minor fatty acid soap selected from the group consisting essentially of: $C_8$, $C_{10}$, $C_{18:2}$ and mixtures thereof;

wherein said bar contains from about 8% to about 25% of said selected oleic and lauric soap, and minor ($C_8$, $C_{10}$, $C_{18:2}$) soaps;

wherein said oleic soap level is from 0% to about 25% by weight of the bar; and said lauric soap is from 0% to about 10% by weight of said bar; and wherein said minor ($C_8$, $C_{10}$, $C_{18:2}$) soap level is from 0% to about 5% by weight of said bar; and wherein said selected lauric/oleic soap to said minor soap have a ratio of from about 1:1 to about 1:0; and wherein said Na/K soap mixture level is from about 90% to about 100% by weight of said total soap; and wherein said Na/K soap has a ratio of from about 19:1 (95/5) to about 1.5:1 (60/40); and wherein said freezer soap bar comprises from about 30% to about 70% of total fatty acid soap by weight of said bar; and III. from about 15% to about 30% of water by weight of said bar.

In view of the above definition, a preferred mild, lathering personal cleansing freezer soap bar comprises:

I. said saturated fatty acid soaps selected from the group consisting of: myristic, palmitic, and stearic acid soaps and mixtures thereof are present at a level of from about 65% to about 80% by weight of total fatty acid soap; and II. from about 20% to about 35% of selected oleic and lauric acid soaps and minor ($C_8$, $C_{10}$, $C_{18:2}$) fatty acid soap;

wherein said bar contains from about 8% to about 25% of said selected oleic and lauric soap, and minor ($C_8$, $C_{10}$, $C_{18:2}$) soaps;

wherein said oleic soap level is from about 5% to about 20% by weight of the bar; and said lauric soap is from about 5% to about 10% by weight of said bar; and wherein said minor ($C_8$, $C_{10}$, $C_{18:2}$) soap level is from about 1% to about 3% by weight of said bar; and wherein said selected lauric/oleic soap and said minor soap have a ratio of from about 1:1 to about 1:0; and wherein said Na/K soap mixture level is from about 95% to about 100% by weight of said total soap; and wherein said Na/K soap has a ratio of from about 90/10 to about 65/35; and wherein said total soap comprises other soap selected from the group consisting of Mg and TEA soaps at a level of from 0% to about 5% by weight of said total soap; and wherein said freezer soap bar comprises by weight of said bar:

A. from about 35% to about 60% of said total fatty acid soap;

B. from 0% to about 30% of nonreducing sugar;

C. from 0% to about 35% of hydrophobic/lipophilic soap additive material; and

D. from about 20% to about 25% of said water.

Another preferred bar of the present invention comprises said selected saturated fatty acid soaps level is from about 65% to about 80% by weight of said total soap; and wherein the sum of said selected minor, lauric, and oleic acid soap level is from about 10% to about 20% by weight of said bar; and wherein said lauric-/oleic soap have a ratio of from about 2:1 to about 1:4; and wherein said Na/K ratio is 90/10 to 65/35; and wherein said lauric/oleic acid soap and said minor ($C_8$, $C_{10}$, $C_{18:2}$) soap have a ratio of about 6:1 to about 4:1.

Yet another preferred freezer bar of this invention comprises: said selected saturated fatty acid soaps level is about 70% to about 75% by weight of said total soap; and wherein the sum level of said lauric and said oleic acid soaps is from about 12% to about 18% by weight of said bar and the ratio of said lauric/oleic acids is from about 1.5:1 to about 1:3 and wherein said Na/K ratio is from 85/15 to 70/30.

Still another preferred freezer bar comprises: said selected saturated fatty acid soaps (myristic, stearic, and palmitic acid soap) level is from about 20% to about 50% by weight of said bar; and wherein said nonreducing sugar is from about 5% to about 20%; and said hydrophobic/lipophilic material is from about 2% to about 25%; and said water is from about 20% to about 25% by weight of said bar; and wherein said bar contains from about 10% to about 20% of said selected lauric/oleic acid soaps by weight of the said bar.

A preferred bar of this invention comprises: said freezer soap bar comprises by weight of said bar: from about 30% to about 55% of said total fatty acid soap; and wherein said oleic acid soap is primarily cis.

A particularly preferred bar of this invention comprises by weight of said bar:

from about 30% to about 55% of said total fatty acid soap;

from about 5% to about 20% of said nonreducing sugar;

from about 5% to about 20% of said hydrophobic/-lipophilic material; and from about 20% to about 25% of said water; and wherein lauric and oleic soap level is from about 12% to about 18% by weight of the said bar;

wherein said oleic soap cis/trans isomer ratio is from about 1:0 to about 20:1.

When the bar contains 95/5 Na/K soap, it should contain some sucrose and/or TEA soap to ensure good lather. Some preferred bars can have a substantial amount of a soap structure disclosed in commonly assigned, copending U.S. Pat. Appln. Ser. No. 07/617,827, filed Nov. 26, 1990, of Kocher, Taneri, Camden, Vest, and Bowles, for a "Shaped Solid Made with a Rigid, Interlocking Mesh of Neutralized Carboxylic Acid," said application being incorporated herein by reference. Such bars can have very little smear formed on standing in a wet soap dish. Such bars comprise a structure which is a continuous or semi-continuous, relatively rigid, interlocking, open, three-dimensional crystalline mesh of neutralized carboxylic acid, i.e., the selected fatty acid soaps defined herein, particularly sodium soap of saturated fatty acids.

I.e., these bars contain a substantial amount (e.g., at least about 5% to about 75% by volume) of the continuous or semi-continuous, rigid, interlocked mesh of neutralized fatty carboxylic acid, preferably sodium soap of saturated fatty acids. Bars containing substantial amounts of said mesh structure tend to be harder, with improved smear. Bars with said mesh structure are not typically translucent. Other advantages of this type of mesh structure and guidance for obtaining said mesh structure are found generally in said U.S. patent application Ser. No. 07/617,827. When a freezer process is used rather than a frame process, additional soap may be required to achieve sufficient viscosity to form a soft plug on exiting the freezer and subsequently still form the same level of structure. Agitation, which tends to destroy the structure, is minimized at the time said mesh structure is forming. Higher levels of individual saturated chain length(s) tend to form the said mesh structure better.

The levels, parts, percentages and ratios herein are by weight unless otherwise specified. Note that the levels of the soaps expressed herein are in terms of weight percent (wt. %) of the total soap and also in terms of wt. % of the bar. All numerical limits, ranges, ratios, etc., are approximations unless otherwise specified.

Within the scope of the invention, there are several different preferred embodiments.

All parts, levels, percentages, and ratios herein are by weight unless otherwise specified. Note that the levels of the soap are expressed herein as weight percent (wt. %) of the total soap and as wt. % of the bar. The numerical limits, ranges, temperatures, ratios, etc., are approximations unless otherwise specified.

The term "insoluble" soap as used herein means soap less soluble than sodium myristate ($C_{14}$).

Soap

The fatty acid soap component (A) suitable for use in the compositions and processes of the present invention includes alkali metal, especially sodium and potassium, ion soaps of higher fatty acids and mixtures thereof, as defined above. Mixtures of sodium and potassium soaps are required for lather. Other cations with similar properties can be used, at least in small amounts, like triethanolammonium (TEA), lithium, and magnesium cations. Such other cations, when used, are used at a level of from 0% to 10%, preferably from about 2% to about 5%, by weight of the total soap.

TABLE 1

| | Solubility of Soaps, Molar, 25° C. | | |
|---|---|---|---|
| | Na | K | Mg |
| $C_{12}$ | 0.11 | Freely | Insoluble |
| $C_{18:1}$ | 0.49 | Freely | N/A |
| $C_{14}$ | 0.004 | Freely | Insoluble |
| $C_{16}$ | Insoluble | N/A | Insoluble |
| $C_{18}$ | Insoluble | N/A | Insoluble |

The term "insoluble" soap as used herein means soap less soluble than sodium myristate.

The term "coconut" as used herein in connection with soap or fatty acid mixtures refers to materials having an approximate carbon chain length distribution of: 8% $C_8$; 7% $C_{10}$; 48% $C_{12}$; 17% $C_{14}$; 9% $C_{16}$; 2% $C_{18}$; 7% $C_{18:1}$ oleic and 2% linoleic (the first six fatty acids being saturated).

The term "palm oil stearin" as used herein refers to materials having an approximate carbon chain length distribution of about: 1% $C_{14}$, 58% $C_{16}$, 5% $C_{18}$, 29% oleic, and 7% linoleic (the first three fatty acids being saturated).

The term "tallow" as used herein refers to a mixture of soaps having an approximate chain length distribution of: 2.5% $C_{14}$; 29% $C_{16}$; 23% $C_{18}$; 2% palmitoleic; 41.5% oleic and 3% linoleic.

The term "triple pressed stearic" as used herein refers to fatty acids having an approximate chain length distribution of 55% palmitic, $C_{16}$, 45% stearic, $C_{18}$.

The term "relatively more soluble soap" as used herein means a soap of which the fatty chain length or level of unsaturation is such that it is more soluble than sodium myristate, or a soap that has the solubility on the order of sodium laurate or oleate soaps, excluding potassium soaps.

The fatty acid soap can be made using pure chain fatty acids, or by using the proper levels and ratios of common fatty acid mixtures such as coconut, palm oil stearin, tallow, and triple pressed stearic.

The preferred levels and ratios can vary with the levels of cation mixtures.

The levels of potassium soap preferably should not exceed about one-third or four-tenths that of the total soap and the level of TEA or magnesium soap should not exceed about one-tenth of the level of total soap, and is preferably less than about one-twentieth that of the total soap. E.g., the sodium soap is preferably at least about 60% of the total soap present in the bar. Na/K ratio range is from 95/5 to 60/40, preferably about 80/20 to 70/30.

TABLE 2

| | Total Fatty Acid Soap | | |
|---|---|---|---|
| | Full | Preferred | More Preferred |
| FA Chain $C_{12+18:1}$ | 15–50% | 20–35% | 25–30% |
| FA Chain $C_{14-18}$ | 50–85% | 65–80% | 70–75% |

Preferably the FA soap $C_{12}/C_{18:1}$ ratio is from about 2:1 to about 1:4, more preferably from about 1.5:1 to about 1:3.

Table 3 shows some preferred levels of FA's used in compositions of the present invention. Some preferred compositions contain little or no short chain FA's of ten carbon atoms or less. The terms "soap" and "fatty acid (FA) salts" as used herein are sometimes interchangeable. "Soap" is normally used since it is easier to relate to and have a generic connotation. The term "soap" as used herein can mean a single fatty acid soap or a mixture of fatty acid soaps. Examples of "minor, more water-soluble soaps" are $C_8$, $C_{10}$, $C_{18:2}$ and the like which are present at a level of from 0% to about 5%, preferably from about 1% to about 3%, by weight of the bar. Such minor soaps help lather.

TABLE 3

| | Percent $C_{12}$, Unsaturated and/or Minor Chain Soaps in Total Bar | | |
|---|---|---|---|
| | Broad | Preferred | More Preferred |
| $C_{12} + C_{18:1}$ + Minors | 8–25% | 10–20% | 12–18% |

Better lather is achieved by using more $C_{18:1}$ cis and potassium cation soaps and, optionally, sugar within the levels and ranges defined herein. It is somewhat surprising that the use of the $C_{18:1}$ cis vs. the $C_{18:1}$ trans, K vs. Na soaps, and sugar, all of which increase soap solubility, are not adverse to mildness.

It is important to selectively balance the amount of more water-soluble lauric and oleic soaps and minor, more water-soluble soaps to from 8–25% by weight of the bar to achieve good lather and mildness. More lather is realized at the higher end of the level (25%) and better mildness is realized at the lower (8%) end of the level.

On the other hand, $C_{18:1}$ cis isomer (which is more soluble than the $C_{18:1}$ trans isomer) is preferred for lather and is surprisingly just as mild as the trans $C_{18:1}$ isomer. In bars which contain oleic acid soap, the lather of such bars is increased with increasing $C_{18:1}$ cis isomer. Conversely, the lather is reduced with more trans and is dramatically reduced when the trans oleic acid isomer is present at a substantial level by weight of the total soap or at a level of about 5–8% or more by weight of the bar. The ratio of oleic cis/trans isomers is from 1:0 to 1:1, preferably 1:0 to 3:1, and more preferably 1:0 to 19:1. The preferred $C_{18:1}$ isomer levels are set out in Table 4.

TABLE 4

| | Wt. % of Oleic $C_{18:1}$ Isomers | | |
|---|---|---|---|
| | Broad | Preferred | More Preferred |
| $C_{18:1}$ trans | 0–50% | 0–25% | 0–5% |
| $C_{18:1}$ cis | 50–100% | 75–100% | 95–100% |

Water

The level of water in the bar can range from about 15% to about about 30%, preferably from about 15% to about 25%, more preferably from about 20% to about 25%. Higher levels of water within these preferred ranges are preferred for mildness and cost reduction. Excess amounts of water can be used in a process for making the bars of this invention; but, when sucrose is used the excess water should be removed prior to the addition of any sucrose to avoid burning (degrading) the sucrose in the 300° F. (149° C.) drying step. In a preferred aerated freezer bar process, the amount of water used does not require a drying step.

It should be noted that in frame bar processes higher levels of water or solvent can be used because the bars are not required to stand up (hold their shape) upon extrusion as in a freezer bar process.

Nonreducing Sugar

The nonreducing sugar, e.g., sucrose, is optional, but preferred. The nonreducing sugar (when used) is used at a level of from about 5% to about 30% and replaces at least a comparable amount of soap. The net effect of less soap in this case is a corresponding mildness benefit, as well as an unexpected processing benefit and a lather benefit.

Sucrose will not reduce Fehling's solution and therefore is classified as a "nonreducing" disaccharide. Sucrose, commonly known as table sugar, is by far the most abundant carbohydrate found in the sap of land plants. It is one of the few nonreducing sugars available in a state of unexcelled purity, in highly crystalline form, on a very large scale, and at low cost. It has been produced since 2000 B.C. from the juice of the sugar cane and since the early 1800's from the sugar beet. Sucrose is a sweet, crystalline (monoclinic) solid which melts at 160°-186° C., depending on the solvent of crystallization.

Unless otherwise specified, the term "sucrose" as used herein includes sucrose, its derivatives, and similar nonreducing sugars and similar polyols which are substantially stable at a soap processing temperature of up to about 210° F. (99° C.), e.g., trialose, raffinose, and stachyose; and sorbitol, lactitol and maltitol.

In contrast, starch, a complex sugar, is a reducing sugar and turns brown or "burns" at the typical soap processing pH and/or temperature. It is important for the preferred execution of the present invention to have a pumpable, stable soap mix which turns pure white upon aeration to provide a white soap bar that floats. Starch increases the viscosity of the soap mix.

The sucrose has an unexpectedly dramatic thinning effect on the soap mix which eliminates the need to add excess water or solvent for homogeneous mixing. Sucrose reduces the viscosity profile of the soap mix that goes into the freezer at comparable shear rates by about 20% up to about 99%. Preferably, the amount of sucrose used to replace a comparable amount of soap would decrease the viscosity of an otherwise comparably dried soap bar mix by at least 50%, and more preferably by at least 75%.

When the soap/sucrose mix is homogeneous, it is then cooled in a freezer to a temperature of from at least about 49° C. to about 66° C. Again, the soap/sucrose mix is still pumpable and has a viscosity which does not require extraordinary equipment or excess water or excess solvent. The use of excess water/solvent requires an additional step for drying. Preferably, no moisture reduction (drying) step is required. The soap/sucrose mixes are preferably formulated without excess water, but so that they are mixable and pumpable. The mixing temperature is typically from about 82° C. to about 100° C. The sucrose/soap composition crutcher mix, upon cooling, is used to make firm, stamped bars which stand up on a freezer process belt.

Alternatively, the sucrose can be added to a dried soap mix and still reduce its viscosity and provide a mildness benefit for the final bar. A "dried soap mix" is a mix wherein the water level has been reduced from about 30% to about 20-25%.

Hydrophobic/Lipophilic (Hydrophobic) Material

A preferred bar of the present invention can contain from 0% to about 35%, preferably from about 2% to about 25%, more preferably from about 5% to about 20%, of hydrophobic/lipophilic (hydrophobic) soap bar additive material; preferably hydrophobic/lipophilic material selected from the group consisting of: (1) wax; (2) other hydrophobic material, including free fatty acids; mono-, di-, and triglycerides; and fatty alcohols containing from about 8 to about 18 carbon atoms in each acyl or alkyl group; and (3) mixtures thereof, and wherein the maximum of said wax is about 25%; and wherein the maximum of said other hydrophobic material is about 10% by weight of the bar.

The hydrophobic material optional component when used in this invention is selected from: waxes; mono-, di-, and triglycerides; fatty acids; fatty alcohols; other similar materials; and mixtures thereof. Preferably the bars contain at least 3% wax and the wax to other hydrophobic material have a ratio of from about 25:1 to about 1:3, more preferably from about 1:1 to about 10:1. The use of a hydrophobic component is highly preferred, but soap bars of the present invention can be made with little, or no, hydrophobic material as shown below in Example 7.

A preferred aerated bar soap composition comprises:

(1) from about 30 wt. % to about 70 wt. % of selected fatty acid soap, as defined hereinabove;
(2) from 10% to about 30% of a nonreducing sugar;
(3) from 3 wt. % to about 30 wt. % of hydrophobic material as defined hereinabove; and
(4) from about 15% to about 30% water.

The hydrophobic material can be present in preferred bars of this invention at a level up to about 30%, but is preferably used at a level of from about 5% to about 20%. The levels of some hydrophobic materials, e.g., fatty acids, can be increased in the bar soap composition as the amount of sucrose is increased. The higher the amount of sucrose present, the more of such hydrophobic material can be present. Soap bars with or without sucrose can benefit from hydrophobic material, particularly the waxes. Triglycerides ($C_8$-$C_{18}$ alkyl chain) can be used up to about 10% without adversely affecting lather performance. The preferred and exemplified bars of the present invention have good lathering properties equal to the industry standard aerated freezer bar soap IVORY ®.

The preferred hydrophobic material is a wax having a melting point (M.P.) of from about 120° F. to about 185° F. (49°-85° C.), preferably from about 125° F. to about 175° F. (52°-79° C.). Another preferred hydrophobic material is petrolatum.

Waxes include petroleum based waxes (paraffin, microcrystalline, and petrolatum), vegetable based waxes (carnauba, palm wax, candelilla, sugarcane wax, and vegetable derived triglycerides) animal waxes (beeswax, spemaceti, wool wax, shellac wax, and animal derived triglycerides), mineral waxes (montar, ozokerite, and ceresin) and synthetic waxes (Fischer-Tropsch).

A preferred paraffin wax is a fully refined petroleum wax having a melting point ranging from about 120° F. to about 160° F. (49°-71° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182, 6971, and 6975, respectively having melting points of 131° F., 130° F. (~55° C.), and 155° F. (~68° C.).

The paraffin preferably is present in the bar in an amount ranging from about 5% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline wax is obtained from Witco Chemical Company under the trade name Multiwax X-145A. The microcrystalline wax preferably is present in the bar in an amount ranging from about 0.5% to about 5% by weight. The microcrystalline wax ingredient imparts pliability to the bar at room temperatures.

Fatty acids are preferably used in the process of the invention. Preferred are those having from 8 to 18 carbon atoms. Normally a mixture of free fatty acids derived from natural sources is employed. Preferred mixtures of fatty acids are the saturated $C_{14}$–$C_{18}$ fatty acid mixtures hereinbefore described.

The free fatty acids improve the quantity and quality of the lathering characteristics of bars prepared in accordance with the process of the present invention. The advantage of free fatty acids in tending to provide a lather of desirable stability and having small air bubbles so as to provide a rich or creamy lather has been known in the art. Fatty acids also provide an emollient effect which tends to soften the skin or otherwise improve feel-on-skin characteristics and scavenge any excess alkalinity.

The amount of free fatty acid incorporated into the preferred finished bars of the invention ranges from about 0.5% to about 8%. A preferred amount of fatty acid ranges from about 2% to about 7%.

The free fatty acid can be incorporated into bars of the present invention in a number of suitable ways. The free fatty acid component is desirably incorporated into the soap mixture either prior to, or simultaneously with, the high-shear mixing step used to form the bar composition. Uniform distribution of the free fatty acid throughout the finished bar composition is facilitated by the high-shearing action. The free fatty acid component can be added subsequent to the high-shear mixing step if other subsequent mixing means are employed so as to substantially uniformly distribute the free fatty acid throughout the soap mixture or resulting bar composition.

The free fatty acid component is preferably introduced into the soap mixtures of the present invention by addition of the free fatty acid to the soap mixture in the initial crutching stage. Alternatively, the free fatty acid component can be introduced prior to or during the aeration stage where perfume and other additives, if desired, are incorporated into the soap mixture. The free fatty acid component can also be introduced as a prepared mixture of soap and free fatty acid, such as an acid-reacting mixture of soap and free fatty acid prepared by under-neutralization in the soap making process.

The bars of this invention can show a mildness improvement without free fatty acids as the result of the presence of the specific fatty acid soaps, either alone or in combination with the sucrose and/or hydrophobic material.

Synthetic Detergent Surfactant

An alternative bar can contain from 0% to about 30%, preferably from about 4% to about 15%, synthetic detergent surfactant, preferably a mild lathering synthetic detergent surfactant; however, the bars of this invention are preferably soap bars with little or no synthetic surfactant.

The optional synthetic detergent surfactant is typically selected from the group consisting of: anionic, nonionic, amphoteric and zwitterionic synthetic detergents. Both low and high lathering and high and low water-soluble surfactants can be used in the bar compositions of the present invention. Suds boosting synthetic detergent surfactants and/or synthetic detergent surfactants that are known as good dispersants for soap curds that are formed in hard water, are particularly desirable.

Examples of suitable synthetic detergents for use herein are those described in U.S. Pat. No. 3,351,558, Zimmerer, issued Nov. 7, 1967, at column 6, line 70 to column 7, line 74, incorporated herein by reference.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, palm kernel oil, palm oil stearin, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

The synthetic surfactants and other optional materials useful in conventional cleaning products are also useful in the present invention. In fact, some ingredients such as certain hygroscopic synthetic surfactants which are normally used in liquids and which are very difficult to incorporate into normal cleansing bars are very compatible in the bars of the present invention. Thus, essentially all of the known synthetic surfactants which are useful in cleansing products are useful in the compositions of the present invention. The cleansing product patent literature is full of synthetic surfactant disclosures. Some preferred surfactants, as well as other cleansing product ingredients, are disclosed in the following references:

| U.S. Pat. No. | Issue Date | Inventor(s) |
|---|---|---|
| 4,061,602 | 12/1977 | Oberstar et al. |
| 4,234,464 | 11/1980 | Morshauser |
| 4,472,297 | 9/1984 | Bolich et al. |
| 4,491,539 | 1/1985 | Hoskins et al. |
| 4,540,507 | 9/1985 | Grollier |
| 4,565,647 | 1/1986 | Llenado |
| 4,673,525 | 6/1987 | Small et al. |
| 4,704,224 | 11/1987 | Saud |
| 4,788,006 | 11/1988 | Bolich, Jr., et al. |
| 4,812,253 | 3/1989 | Small et al. |
| 4,820,447 | 4/1989 | Medcalf et al. |
| 4,906,459 | 3/1990 | Cobb et al. |
| 4,923,635 | 5/1990 | Simion et al. |
| 4,954,282 | 9/1990 | Rys et al. |

All of said patents are incorporated herein by reference. Some preferred synthetic surfactants are shown in the Examples herein. Preferred synthetic surfactant systems are selectively designed for bar appearance, stability, lather, cleansing and mildness.

It is noted that surfactant mildness can be measured by a skin barrier destruction test which is used to assess the irritancy potential of surfactants. In this test the milder the surfactant, the less the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference. These references disclose a mild alkyl glyceryl ether sulfonate (AGS) surfactant based synbar comprising a "standard" alkyl glyceryl ether sulfonate mixture and define the criteria for a "mild surfactant." Barrier destruction testing is used to select mild surfactants. Some preferred mild synthetic surfactants are disclosed in the above Small et al. and Rys et al. patents. Some specific examples of preferred surfactants are used in the Examples herein.

Some examples of good mild, lather-enhancing, synthetic detergent surfactants are, e.g., sodium lauroyl sarcosinate, alkyl glyceryl ether sulfonate, sulfonated fatty esters, and sulfonated fatty acids.

Numerous examples of other surfactants are disclosed in the patents incorporated herein by reference. They include other alkyl sulfates, anionic acyl sarcosinates, methyl acyl taurates, N-acyl glutamates, acyl isethionates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these other surfactants are $C_8$–$C_{22}$, preferably $C_{10}$–$C_{18}$. Alkyl glycosides and methyl glucose esters are preferred mild nonionics which can be mixed with other mild anionic or amphoteric surfactants in the compositions of this invention. Alkyl polyglycoside detergents are useful lather enhancers. The alkyl group can vary from about 8 to about 22 and the glycoside units per molecule can vary from about 1.1 to about 5 to provide an appropriate balance between the hydrophilic and hydrophobic portions of the molecule. Combinations Of $C_8$–$C_{18}$, preferably $C_{12}$–$C_{16}$, alkyl polyglycosides with average degrees of glycosidation ranging from about 1.1 to about 2.7, preferably from about 1.2 to about 2.5, are preferred.

Sulfonated esters of fatty esters are preferred wherein the chain length of the carboxylic acid is $C_8$–$C_{22}$, preferably $C_{12}$–$C_{18}$; the chain length of the ester alcohol is $C_1$–$C_6$. These include sodium methyl alpha-sulfo laurate, sodium methyl alpha-sulfo cocoate, and sodium methyl alpha-sulfo tallowate.

Amine oxide detergents are good lather enhancers. Some preferred amine oxides are $C_8$–$C_{18}$, preferably $C_{10}$–$C_{16}$, alkyl dimethyl amine oxides and $C_8$–$C_{18}$, preferably $C_{12}$–$C_{16}$, fatty acyl amidopropyl dimethyl amine oxides and mixtures thereof.

Fatty acid alkanolamides are good lather enhancers. Some preferred alkanolamides are $C_8$–$C_{18}$, preferably $C_{12}$–$C_{16}$, monoethanolamides, diethanolamides, and monoisopropanolamides and mixtures thereof.

Other detergent surfactants are alkyl ethoxy carboxylates having the general formula $$RO(CH_2CH_2O)_kCH_2COO^-M^+$$

wherein R is a $C_{8-22}$ alkyl group, k is an integer ranging from 0 to 10, and M is a cation; and polyhydroxy fatty acid amides having the general formula $$R^2-\overset{\overset{\displaystyle O}{\|}}{C}-\overset{\overset{\displaystyle R^1}{|}}{N}-Z$$

wherein $R^1$ is H, a $C_{1-4}$ hydrocarbyl, 2-hydroxy ethyl, 2-hydroxy propyl, or mixtures thereof, $R^2$ is a $C_{5-31}$ hydrocarbyl, and Z is a polyhydroxyhydrocarbyl having a linear hydrocarbyl chain with at least 3 hydroxyl groups directly connected to the chain, or an alkoxylated derivative thereof.

Betaines are good lather enhancers. Betaines such as $C_8$–$C_{18}$, preferably $C_{12}$–$C_{16}$, alkyl betaines, e.g., coco betaines or $C_8$–$C_{18}$, preferably $C_{12}$–$C_{16}$, acyl amido betaines, e.g., cocoamidopropyl betaine, and mixtures thereof, are preferred.

Examples of specific surfactants follow.

---

Class: Nonionic

Sulfonates

Na $C_8$ Glyceryl Ether Sulfonate
Na $C_{12-14}$ Glyceryl Ether Sulfonate
Na $C_{16}$ Glyceryl Ether Sulfonate
Sodium Cocomonoglyceride Sulfonate
Sodium Salt of $C_{8-16}$ Alkyl Glyceryl Ether Sulfonates Alpha Sulfo Esters and Acids Na Alpha Sulfo Methyl Laurate/Myristate
Na Alpha Sulfo Methyl Myristate
Na Alpha Sulfo Hexyl Laurate
Na Alpha Sulfo Methyl/Hexyl Laurate and Myristate
Na Alpha Sulfo Methyl Palmitate
Na Alpha Sulfo Methyl Stearate
Na 2-Sulfo Lauric Acid
Na 2-Sulfo Palmitic Acid
Na 2-Sulfo Stearic Acid
$R_1$-$C(SO_3$-$Na^+)$—$CO_2R_2$ $R_1 = C_{8-14}$; $R_2 = C_{1-8}$ Sodium Alkyl Isethionates Sodium Lauryl Isethionate
Sodium Cocoyl Isethionate Sarcosinates Sodium Lauryl Sarcosinate
Sodium Stearyl Sarcosinate
Sodium Cocoyl Sarcosinate Alkyl Sulfates Sodium Lauryl Sulfate
Sodium Laureth-1 Sulfate
Sodium Oleyl Sulfate
Sodium Cetearyl Sulfate
Sodium Cetyl Sulfate
$R_1(OCH_2CH_2)_nOSO_3$-X $R_1 = C_{8-14}$, $C_{16-20}$ with at least one double bond, X = 0–18

Acyl Glutamates

Sodium Cocoyl Glutamate
Sodium Lauryl Glutamate
Sodium Myristyl Glutamate
Sodium Stearyl Glutamate Alkyl Ether Carboxylates Sodium Laureth-5 Carboxylate
Sodium Palmityl-20 Carboxylate
$R_1(O—CH_2CH_2)nCO_2$— $R_1 = C_{8-18}$, n = 1–30

Sulfosuccinates

Disodium Laureth Sulfosuccinate

Phosphates

Sodium Monoalkyl (70% $C_{12}$/30% $C_{14}$) Phosphate

Class: Amphoterics

Betaines

Coco Betaine

-continued

| |
|---|
| Cocoamidopropyl Betaine |
| Palmitylamidopropyl Betaine |
| Isostearamidopropyl Betaine |
| Sultaines |
| Cocoamidopropylhydroxy Sultaine |
| Amine Oxides |
| Palmityl Dimethyl Amine Oxide |
| Myristyl Dimethyl Amine Oxide |
| Cocoamidopropyl Amine Oxide |
| Protein Derived |
| Na/TEA $C_{12}$ Hydrolyzed Keratin |

The bar compositions of the present invention can optionally contain from about 1% to about 30% organic nonsoap synthetic detergent, preferably at a level of from about 4% to about 25%, more preferably from about 5% to about 20%, weight of the bar. Normally the soap/synthetic bars are prepared to contain a ratio of soap to synthetic detergent of form about 3:1 to about 25:1. The choice of suitable ratios will depend upon the particular synthetic detergent, the desired performance and physical characteristics of the finished bar, temperature, moisture and like processing considerations. A preferred ratio is from about 4:1 to about 7:1.

The bars of this invention do not require the optional ingredients, thus zero is the lowest level for each optional ingredient. Some preferred bars contain from about 1% to about 65% of selected optional ingredients.

The levels set out in Other Ingredients Table are particularly illustrative for bars containing other optional ingredients.

OTHER INGREDIENTS TABLE
Practical Wt. % of Other Ingredients

| | Preferred | More Preferred | Most Preferred |
|---|---|---|---|
| Filler Salts and Salt Hydrates | 0.5-50% | 0.75-25% | 1-15% |
| Water-Soluble Organics | 1.0-50% | 2-40% | 5-20% |
| Polymeric Mildness Enhancers | 0.25%-20% | 0.5%-10% | 1-5% |
| Other Impalpable Water-insolubles | 1-60% | 2-30% | 4-25% |
| Aluminosilicates/Clay | 0.5-25% | 1-10% | 3-8% |

The bar soap compositions of -the present invention can contain other additives commonly included in toilet bars such as perfumes, other fillers, sanitizing or antimicrobial agents, dyes, and the like.

Polymeric skin mildness aids are disclosed in the Small et al. and Medcalf et al. patents. The cationic synthetic polymers useful in the present invention are cationic polyalkylene imines, ethoxypolyalklene imines, and poly[N-[-3-(dimethylammonio)propyl]-N'-[3-(ethyleneoxyethylene dimethylammonio)propyl]urea dichloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR C-14-S, C-15 and C-17 sold by Celanese Corporation. In order to achieve the benefits described in this invention, the polymer must have characteristics, either structural or physical which allow it to be suitably and fully hydrated and subsequently well incorporated into the soap matrix.

A mild skin cleansing bar of the present invention can contain from about 0.5% to about 20% of a mixture of a silicone gum and a silicone fluid wherein the gum:fluid ratio is from about 10:1 to about 1:10, preferably from about 4:1 to about 1:4, most preferably from about 3:2 to about 2:3.

Silicone gum and fluid blends have been disclosed for use in shampoos and/or conditioners in U.S. Pat. No.: 4,906,459, Cobb et al., issued Mar. 6, 1990; U.S. Pat. No. 4,788,006, Bolich, Jr. et al., issued Nov. 29, 1988; U.S. Pat. No. 4,741,855, Grote et al., issued May 3, 1988; U.S. Pat. No. 4,728,457, Fieler et al., issued Mar. 1, 1988; U.S. Pat. No. 4,704,272, Oh et al., issued Nov. 3, 1987; and U.S. Pat. No. 2,826,551, Geen, issued Mar. 11, 1958, all of said patents being incorporated herein by reference.

The silicone component can be present in the bar at a level which is effective to deliver a skin mildness benefit, for example, from about 0.5% to about 20%, preferably from about 1.5% to about 16%, and most preferably from about 3% to about 12% of the composition. Silicone fluid, as used herein, denotes a silicone with viscosities ranging from about 5 to about 600,000 centistokes, most preferably from about 350 to about 100,000 centistokes, at 25° C. Silicone gum, as used herein, denotes a silicone with a mass molecular weight of from about 200,000 to about 1,000,000 and with a viscosity of greater than about 600,000 centistokes. The molecular weight and viscosity of the particular selected siloxanes will determine whether it is a gum or a fluid. The silicone gum and fluid are mixed together and incorporated into the compositions of the present invention.

Other ingredients of the present invention are selected for the various applications. E.g., perfumes can be used in formulating the skin cleansing products, generally at a level of from about 0.1% to about 2.0% of the composition. Alcohols, hydrotropes, colorants, and fillers such as talc, clay, water-insoluble, impalpable calcium carbonate, starch, and dextrin can also be used. The preferred bar of this invention contains from about 3% to about 5% impalpables, preferably, calcium carbonate. These additives make the finished bar compositions either more attractive or effective without detracting from the desirable attributes of the bar. Cetearyl alcohol is a mixture of cetyl and stearyl alcohols. Preservatives, e.g., sodium ethylenediaminetetraacetate (EDTA), generally at a level of less than 1% of the composition, can be incorporated in the cleansing products to prevent color and odor degradation. Antibacterials can also be incorporated, usually at levels up to 1.5%. The above patents disclose or refer to such ingredients and formulations which can be used in the bars of this invention, and are incorporated herein by reference.

Some bars of this invention contain at least about 1% of another bar ingredient selected from: other soaps, moisturizers, colorants, solvents, fillers, synthetic detergent surfactants, polymeric skin feel and mildness aids, perfumes, preservatives, and mixtures thereof.

Compatible salt and salt hydrates can be used as fillers. Some preferred salts are sodium chloride, sodium sulfate, disodium hydrogen phosphate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, methyl sulfate, and citrate.

Water-soluble organics can also be used to stabilize the appearance of the bar soaps of the present invention. Some preferred water-soluble organics are propylene glycol, glycerine, ethylene glycol, sucrose, and urea, and other compatible polyols.

A particularly suitable water-soluble organic is propylene glycol. Other compatible organics include polyors, such as ethylene glycol or 1,7-heptane-diol, respectively the mono- and polyethylene and propylene glycols of up to about 8,000 molecular weight, any mono-$C_{1-4}$ alkyl ethers thereof, sorbitol, glycerol, glycose, diglycerol, sucrose, lactose, dextrose, 2-pentanol, 1-butanol, mono- di- and triethanolamine, 2-amino-1-butanol, and the like, especially the polyhydric alcohols.

Water-soluble amine salts can also be used. Monoethanolamine, diethanolamine, and triethanolamine (TEA) chloride salts are preferred.

Aluminosilicates and other clays are useful in the present invention. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Another preferred clay is kaolin.

Preferred Bar Processing

The following process is used to make the exemplified freezer bars of the present invention. The process comprises the following steps:

I. Mixing a soap composition comprising:
- (A) from about 30% to about 70% of the above defined selected fatty acid soap;
- (B) from 0% to about 20% synthetic detergent surfactant, preferably mild synthetic detergent surfactant, as defined above;
- (C) from 0% to about 30%; preferably from about 5% to about 30%, more preferably from about 5% to about 20%, of nonreducing sugar, preferably sucrose (Note: The addition of sucrose to an aerated or a freezer soap bar process results in a more processable soap mix which does not require as much drying or moisture reduction.);
- (D) from 0% to about 30%, preferably from about 2% to about 25%, more preferably from about 5% to about 20%, of hydrophobic/lipophilic soap bar additive material as defined hereinabove; and
- (E) from about 15% to about 30%, preferably from about 20% to about 25%, water;

wherein said fatty acids, sugar, wax, and other ingredients are mixed at a temperature of from about 65° C. to about 74° C. (from about 150° F. to about 165° F.); soap is made in situ by blending the selected fatty acids into dilute NAOH and KOH at an initial temperature of from about 52° C. to about 57° C. (125°-135° F.) and a final temperature of from about 85° C. to about 99° C. (185°-210° F.); the other ingredients are added; and wherein, if and when said mix is dried to reduce the amount of said water, preferably said sugar/sucrose is added after said drying or in place of drying;

II. Aerate (optional) said mix and add perfume with positive displacement pump or other in line mixer;

III. Cool the mix using a scraped wall heat exchanger (freezer) to crystallize the components from an initial temperature of from about 79° C. to about 99° C. (from about 175° F. to about 210° F.) to a final temperature of from about 46° C. to about 66° C. (115°-155° F.), preferably from about 49° C. to about 60° C. (120°-140° F.); and IV. Cooled mix of Step III. is extruded out onto a moving belt as a soft plug which is then cooled and fully crystallized and then stamped and packaged.

A process for making a nonaerated soap bar from the composition comprises the steps of:

1. Mixing said (A)-(E) as above;
2. Cooling said mix of Step I. to a temperature as above; and
3. Forming said nonaerated bars (plugs) from said cooled mix as above.

The optimum mixing temperatures of the above steps can vary depending on the particular formulation. Preferably, the formed soap bars (plugs) of Step IV. are formed from a mix which is cooled sufficiently to provide free standing bars (plugs). The preferred process does not require a moisture reduction step. The plugs are preferably formed via an extrusion operation, as shown in U.S. Pat. No. 3,835,058, supra.

Nonaerated freezer bar soap compositions preferably contain less than about 5% of organic solvents, e.g., alcohols, etc. Preferably they contain less than 3% of such organic solvents and, more preferably, from 0% to less than about 1% of such organic solvents is added. A preferred process does not have a drying step.

In a continuous freezer bar process the formed bars (plugs) stand up on a belt. Many cast bar compositions which use higher levels of water and/or organic solvent, e.g., 40-50% water, will not hold their forms or stand up on a freezer bar belt. Similarly, many bars which depend on the formation of large detergent, or soap, crystals to set up will not stand up on the belt.

Frequently, some of the composition crystallizes in the freezer in order to provide sufficient viscosity to stand up on the belt, while further crystallization occurs after exiting the freezer, resulting in hardening of the bar. For some preferred bars, the later crystallization results in substantial structure of the type disclosed in U.S. patent application Ser. No. 07/617,827, supra, incorporate herein by reference.

The formed freezer bars (plugs) containing sucrose typically hold their forms better and stand up on the belt. In the freezer step, lowering the temperature of the composition by a delta of from about 10° C. to about 60° C., preferably by a delta of from about 15° C. to about 50° C., is sufficient to create a dimensionally stable plug that does not slump while being processed. Needless to say, the elimination of a costly and time consuming moisture or solvent reducing (drying) step in a freezer bar process or a cast bar process is an advantage. See the Figure of U.S. Pat. No. 3,835,058, supra, for a schematic drawing of a prior art continuous freezer soap bar making process with a moisture reducing step.

Bar Soap Handwash Lather Volume Test

The handwash lather test is used to provide in-use lather volume measurements for the lather performance of skin cleansing bars. The test measures both the ultimate lather volume generated and the volume which is generated after a very short lathering period (to reflect lathering ease). The lather volumes are generated under soil-loaded conditions.

Synthetic soil is used for the soil-loaded lather volume test reported herein. Its formula and procedure for making it are set out below.

| Synthetic Soil | |
|---|---|
| Ingredients | Wt. % |
| Hyfac 430[a] | 1.87 |
| Lauric Acid[b] | 1.42 |
| Neo-fat 14[c] | 5.68 |
| Neo-fat 16[d] | 11.16 |
| Neo-fat 18[e] | 5.40 |
| Neo-fat 90-04[f] | 9.81 |
| Industrene 226[g] | 1.26 |
| Paraffin Wax | 7.30 |
| Squalane[h] | 3.70 |
| Lanolin Anhydrous | 19.40 |
| Coconut Oil | 3.30 |
| Tallow | 29.70 |
| | 100.00% |

[a]Emery Industries, Inc., Cincinnati, Ohio
[b]Emery Industries, Inc., Cincinnati, Ohio
[c]Armour Industrial Chemical Co., Chicago, Illinois
[d]Armour Industrial Chemical Co., Chicago, Illinois
[e]Armour Industrial Chemical Co., Chicago, Illinois
[f]Armour Industrial Chemical Co., Chicago, Illinois
[g]Humko Products, Memphis, Tennessee
[h]Robeco Chemicals, Inc., New York, New York Procedure 1. Heat above materials together stirring continuously between 160°-175° F.
2. Mix 25 parts of above formula with 25 parts of a 5% to 80% tallow/20% coconut soap solution and 50 parts of distilled water at 150° F.
3. Cool mixture to room temperature while stirring constantly.
4. Store in covered glass container.

Equipment

The following equipment is used:

1. Water source and sink with temperature control. The water source should be medium hardness (6-9 grain/gallon) for most testing, although water of lower and higher hardness can be used for special purposes.
2. Synthetic soil (see Table 1).
3. Paper towels.
4. Test bars.
5. Control bars.

Procedure

The following procedure is used:

1. Set temperature at 95°-100° F.
2. Rub 0.22 cc of soil on hands.
3. Wet hands.
4. Rotate bar 3 times in both hands.
5. Add a little water, rub both hands 5 times.
6. Rotate hands 3 times (without soap), grade for flash volume.
7. Rotate 7 more times, grade for ultimate volume.
8. Collect lather and deposit on sink top.
9. Compare volume with standard bar target volume and assign grade.

Grading Scale

Soil Loaded

7—Exceptional
6—Very much higher than target
5—Higher than target
4—Target volume
3—Slightly lower than target
2—Lower than target

EXAMPLES

The following Examples illustrate the practice of this invention and are not intended to be limiting. All percentages, parts and ratios herein are by weight unless otherwise specified. The free fatty acids used in the examples are used at about the same ratio as the fatty acid soaps. The soaps are made in situ, unless otherwise specified. The levels of soaps are given as a total soap weight percent (wt. %), as well as a bar weight percent (wt. %).

The soap bar compositions of the Examples are mixed at a temperature of about 190° F. (88° C.) and pumped into a scraped wall heat exchanger where the temperature of the mix is cooled to about 130° F. (55° C.) and where the mix is aerated. The aerated and cooled soap mix is then extruded and bar plugs are cut and conditioned. The final bars are then stamped.

The following Examples are illustrative and are not intended to limit the scope of the invention. All levels and ranges, temperatures, results etc., used herein are approximations unless otherwise specified.

COMPARATIVE BAR VS. EXAMPLE 1

| Approximate Chain Length Distribution (Wt. %) (The percent by weight of total soap is given parenthetically) | | | | |
|---|---|---|---|---|
| | Comparative Bar (CB) | | Example 1 | |
| Na/K Ratio | 80/20 | | 75:25 | |
| Ingredient | In Bar Wt. % | In Soap Wt. % | In Bar Wt. % | In Soap Wt. % |
| $C_8$ | 1.30 | (1.73) | 0.91 | (1.79) |
| $C_{10}$ | 1.10 | (1.47) | 0.78 | (1.53) |
| $C_{12}$ | 9.40 | (12.53) | 6.72 | (13.20) |
| $C_{14}$ | 6.00 | (8.00) | 2.81 | (5.53) |
| $C_{16}$ | 16.80 | (22.40) | 21.66 | (42.58) |
| $C_{18}$ | 13.60 | (18.13) | 9.67 | (19.02) |
| $C_{18:1}$ | 24.90 | (33.20) | 6.91 | (13.59) |
| $C_{18:2}$ | 1.90 | (2.53) | 1.40 | (2.75) |
| Total Soap | 75.69 | | 50.86 | |
| Water | 23.76 | | 23.00 | |
| Sucrose | — | | 7.50 | |
| Paraffin (M.P. 52-79° C.) | — | | 7.50 | |
| Ca Carbonate | — | | 4.00 | |
| FFA (same as soap) | — | | 6.00 | |
| Free Caustic | 0.05 | | — | |
| Minors (Perfumes, Preservatives) | 0.50 | | 1.14 | |
| Totals | 100.00 | | 100.00 | |

Example 1 is significantly milder than the Comparative Bar (CB), in a forearm wash test, and is about as mild as a very mold, commercially available combo bar, Neutrogena ® Dry Skin Formula:

| Approximate Neutrogena ® Formula | |
|---|---|
| Ingredient | Wt. % |
| Na 80T/20Cn Soap | 30 |
| TEA 80T/20Cn Soap | 30 |
| Free TEA | 15 |
| Glycerine | 10 |
| Nonionic Surfactant | 8.4 |
| Water | 5.5 |
| Minors | 1.1 |
| Total | 100.0 |

The forearm wash test is a modified Lukacovic, Dunlap, Michaels, Visscher, and Watson: "Forearm wash test to evaluate the clinical mildness of cleansing products," J. Soc. Cosmet. Chem., 39, 355-366 (November/-December 1988). One week of testing is used instead of two weeks.

Advantages of Example 1 versus the Comparative Bar and other mild bars are:

1. Example 1 is much milder than the Comparative Bar (CB).
2. The lather volumes are about the same (usually milder bars lather much less).
3. Example 1 has a creamier lather than the Comparative Bar.
4. Example 1 is made by using a simpler process.
5. Example 1 does not wear away as fast as other bars in its mildness class (e.g., Neutrogena ®).
6. Example 1 is less expensive than other bars in its mildness class.

The $C_{18:1}$ in Example 1 is substantially all cis isomer. The trans/cis content of the $C_{18:1}$ in "CB" is 60/40.

The major differences between CB and Example 1 are: (1) CB has $C_{12}$ soap at 9.4% in bar, and Example 1 has $C_{12}$ at 6.7% (delta is 2.7% by wt. % of bar); (2) CB has $C_{18:1}$ at 24.9% by wt. % of bar, and Example 1 has $C_{18:1}$ at about 6.9% by wt. % of bar (delta is 18%).

The Comparative Bar (CB) contains a total of about 75% soap by weight of the bar and the $C_{12}$ and $C_{18:1}$ content by weight of total soap is 45.7% (12.5% and 33.5%); the bar wt. % of $C_{12}$ and $C_{18:1}$ for CB is 34.3% or 9.3% over the maximum level of 25% for the bar of the present invention.

SYNTHETIC EXAMPLES 2 AND 3

Approximate Chain Length Distribution (Wt. %)
(The percent by weight of total soap is given parenthetically)

| | Example 2 | | Example 3 | |
|---|---|---|---|---|
| Na/K Ratio | 75:25 | | 67:33 | |
| Ingredient | In Bar Wt. % | In Soap Wt. % | In Bar Wt. % | In Soap Wt. % |
| $C_8$ | 0.91 | (1.79) | 0.76 | (1.75) |
| $C_{10}$ | 0.78 | (1.53) | 0.65 | (1.50) |
| $C_{12}$ | 6.69 | (13.20) | 5.70 | (13.07) |
| $C_{14}$ | 2.80 | (5.53) | 2.43 | (5.58) |
| $C_{16}$ | 21.56 | (42.58) | 19.28 | (44.20) |
| $C_{18}$ | 9.63 | (19.02) | 5.09 | (11.66) |
| $C_{18:1}$ | 6.88 | (13.59) | 8.06 | (18.48) |
| $C_{18:2}$ | 1.39 | (2.75) | 1.64 | (3.76) |
| Total Soap | 50.64 | | 43.63 | |
| Water | 23.00 | | 28.15 | |
| Sucrose | 6.00 | | 5.58 | |
| Paraffin (M.P. 52-79° C.) | 6.00 | | 6.86 | |
| Ca Carbonate | — | | 3.43 | |
| Sodium Coconut Alkyl Glyceryl Ether Sulfonate (AGS) | 8.00 | | 7.51 | |

-continued

Approximate Chain Length Distribution (Wt. %)
(The percent by weight of total soap is given parenthetically)

| | Example 2 | | Example 3 | |
|---|---|---|---|---|
| Na/K Ratio | 75:25 | | 67:33 | |
| Ingredient | In Bar Wt. % | In Soap Wt. % | In Bar Wt. % | In Soap Wt. % |
| FFA (same as soap) | 4.00 | | 3.43 | |
| Minors | 1.86 | | 1.41 | |
| Totals | 100.00 | | 100.00 | |

Examples 2 and 3 are similar to Example 1 in mildness and lather.

ALL SOAP EXAMPLES 4 AND 5

Approximate Chain Length Distribution (Wt. %)
(The percent by weight of total soap is given parenthetically)

| | Example 4 | | Example 5 | |
|---|---|---|---|---|
| Na/K Ratio | 85:15 | | 85:15 | |
| Ingredient | In Bar Wt. % | In Soap Wt. % | In Bar Wt. % | In Soap Wt. % |
| $C_8$ | — | (—) | — | (—) |
| $C_{10}$ | — | (—) | — | (—) |
| $C_{12}$ | 10.00 | (23.26) | 7.60 | (17.67) |
| $C_{14}$ | 5.00 | (11.63) | 4.20 | (9.77) |
| $C_{16}$ | 8.50 | (19.77) | 9.30 | (21.63) |
| $C_{18}$ | 7.30 | (16.98) | 8.30 | (19.30) |
| $C_{18:1}$ | 11.80 | (27.44) | 13.20 | (30.70) |
| $C_{18:2}$ | 0.40 | (0.93) | 0.40 | (0.93) |
| Total Soap | 43.00 | | 43.00 | |
| Water | 23.00 | | 23.00 | |
| Sucrose | 10.00 | | 10.00 | |
| Paraffin (M.P. 52-79° C.) | 15.00 | | 15.00 | |
| Ca Carbonate | 4.00 | | 4.00 | |
| FFA (same as soap) | 4.00 | | 4.00 | |
| Minors | 1.00 | | 1.00 | |
| Totals | 100.00 | | 100.00 | |

Examples 4 and 5 have varying levels of $C_{12}$ and $C_{18:1}$. the cis/trans $C_{18:1}$ ratio in Examples 4 and 5 is about 1:1. Their lathers are acceptable, but comparable bars with all cis isomer lather better than Examples 4 and 5.

EXAMPLE 6

Approximate Chain Length Distribution (Wt. %)
(The percent by weight of total soap is given parenthetically)

| | Example 6 | |
|---|---|---|
| Na/K Ratio | 70:30 | |
| Ingredient | In Bar Wt. % | In Soap Wt. % |
| $C_8$ | — | (—) |
| $C_{10}$ | — | (—) |
| $C_{12}$ | 8.00 | (18.60) |
| $C_{14}$ | 3.40 | (7.91) |
| $C_{16}$ | 18.40 | (42.79) |
| $C_{18}$ | 1.80 | (4.19) |
| $C_{18:1}$ | 9.50 | (22.09) |
| $C_{18:2}$ | 1.90 | (4.42) |
| Total Soap | 43.00 | |
| Water | 23.00 | |
| Sucrose | 12.00 | |
| Paraffin (M.P. 52-79° C.) | 13.00 | |
| Ca Carbonate | 4.00 | |
| FFA (same as soap) | 4.00 | |
| Minors | 1.00 | |
| Total | 100.00 | |

The $C_{18:1}$ in Examples 6 and 7 is substantially all cis.

EXAMPLE 7

| Approximate Chain Length Distribution (Wt. %) (The percent by weight of total soap is given parenthetically) | | |
|---|---|---|
| | Example 7 | |
| Na/K Ratio | 70:30 | |
| Ingredient | In Bar Wt. % | In Soap Wt. % |
| $C_{12}$ | 4.6 | (12.4) |
| $C_{14}$ | 2.0 | (5.4) |
| $C_{16}$ | 17.9 | (48.4) |
| $C_{18}$ | 1.6 | (4.3) |
| $C_{18:1}$ | 9.1 | (24.6) |
| $C_{18:2}$ | 1.8 | (4.9) |
| Total Soap | 37.0 | |
| Water | 30.0 | |
| Starch (common corn) | 20.0 | |
| FFA (same as soap) | 3.0 | |
| Minors | 1.00 | |
| Propylene Glycol | 5 | |
| Polyethylene Glycol (PEG) | 4 | |
| Total | 100.00 | |

Example 7 has no sugar, wax, or synthetic. This Example has good lather and is milder than CB.

EXAMPLE 8

Example 8 is the same as Example 5, except that Example 8 has a $C_{18:1}$ cis/trans isomer ratio of about 0.8:1. Example 8 is mild, but does not lather as well as Example 5. Example 5 has a lower level of trans oleic acid soap and has better lather.

EXAMPLE 9

| Approximate Chain Length Distribution (Wt. %) (The percent by weight of total soap is given parenthetically) | | |
|---|---|---|
| | Example 9 | |
| Na/K Ratio | 80:20 | |
| Ingredient | In Bar Wt. % | In Soap Wt. % |
| $C_{12}$ | 10 | (20) |
| $C_{14}$ | 40 | (80) |
| Total Soap | 50.0 | |
| Water | 25.0 | |
| Sucrose | 24.0 | |
| FFA (same as soap) | 1.0 | |
| Total | 100.0 | |

Example 9 contains a semi-continuous, relatively rigid interlocking, open, three-dimensional mesh structure. The composition is mixed at a temperature of 170° F. (200° C.) and pumped into a scraped wall heat exchanger where the temperature of the mix is cooled to 120° F. (160° C.). The mix is then extruded and bar plugs are cut and then conditioned. The final bars are then stamped.

The bars of Examples 1–9 are milder than the Comparative Bar (CB), which is representative of the-prior art. The Comparative Bar is the standard freezer bar for lather. Example 4 is slightly less mild than Examples 1–3 and Examples 5–6; but is significantly milder than the CB.

Example 1 is significantly milder than the Comparative Bar (CB), in a forearm wash test, and is about as mild as a very mild, commercially available combo bar, Neutrogena ® Dry Skin Formula.

What is claimed is:

1. A mild, lathering personal cleansing freezer soap bar comprising:

I. saturated fatty acid soaps selected from the group consisting of: myristic, palmitic, and stearic acid soaps and mixtures thereof at a level of from about 65% to about 85% by weight of total fatty acid soap; and II. from about 15% to about 35% of soap selected from the group consisting of: oleic and lauric acid soaps and minor fatty acid soap selected from the group consisting essentially of: $C_8$, $C_{10}$, $C_{18:2}$ and mixtures thereof;

wherein said bar contains from about 8% to about 25% of said selected oleic and lauric soap, and minor soaps;

wherein said oleic soap level is from 0% to about 25% by weight of the bar; and said lauric soap is from 0% to about 10% by weight of said bar; and wherein said minor ($C_8$, $C_{10}$, $C_{18:2}$) soap level is from 0% to about 5% by weight of said bar; and wherein said selected lauric/oleic soap to said minor ($C_8$, $C_{10}$, $C_{18:2}$) soap have a ratio of from about 1:1 to about 1:0; and wherein said soap is a mixture of sodium and potassium soap (Na/K); and wherein said Na/K soap mixture level is from about 90% to about 100% by weight of said total soap; and wherein said Na/K soap has a ratio of from about 19:1 (95/5) to about 1.5:1 (60/40); and wherein said freezer soap bar comprises from about 30% to about 70% of total fatty acid soap by weight of said bar; and III. from about 15% to about 30% of water by weight of said bar.

2. The mild, lathering personal cleansing freezer soap bar of claim 1 wherein:

I. said saturated fatty acid soaps selected from the group consisting of: myristic, palmitic, and stearic acid soaps and mixtures thereof are present at a level of from about 65% to about 80% by weight of total fatty acid soap; and II. from about 20% to about 35% of selected oleic and lauric acid soaps and minor fatty acid soap;

wherein said bar contains from about 8% to about 25% of said selected oleic and lauric soap, and minor ($C_8$, $C_{10}$, $C_{18:2}$) soaps;

wherein said oleic soap level is from about 5% to about 20% by weight of the bar; and said lauric soap is from about 5% to about 10% by weight of said bar; and wherein said minor ($C_8$, $C_{10}$, $C_{18:2}$) soap level is from about 1% to about 3% by weight of said bar; and wherein said selected lauric/oleic soap and said minor soap have a ratio of from about 1:1 to about 1:0; and wherein said Na/K soap mixture level is from about 95% to about 100% by weight of said total soap; and wherein said Na/K soap has a ratio of from about 90/10 to about 65/35; and wherein said total soap comprises other soap selected from the group consisting of Mg and TEA soaps at a level of from 0% to about 5% by weight of said total soap; and wherein said freezer soap bar comprises by weight of said bar:

A. from about 35% to about 60% of said total fatty acid soap;

B. from 0% to about 30% of nonreducing sugar;

C. from 0% to about 35% of hydrophobic/lipophilic soap additive material; and

D. from about 20% to about 25% of said water.

3. The mild, lathering freezer soap bar of claim 1 wherein said selected saturated fatty acid soaps level is from about 65% to about 80% by weight of said total soap; and wherein the sum of said selected minor, lauric, and oleic acid soap level is from about 10% to about 20% by weight of said bar;

and wherein said lauric/oleic soap have a ratio of from about 2:1 to about 1:4; and wherein said Na/K ratio is 90/10 to 65/35; and wherein said lauric/oleic acid soap and said minor soap have a ratio of from about 6:1 to about 4:1.

4. The mild, lathering freezer soap bar of claim 2 wherein said selected saturated fatty acid soaps level is about 70% to about 75% by weight of said total soap; and wherein the sum level of said lauric and said oleic acid soaps is from about 12% to about 18% by weight of said bar and the ratio of said lauric/oleic acids is from about 1.5:1 to about 1:3 and wherein said Na/K ratio is from 85/15 to 70/30.

5. The mild, lathering freezer soap bar of claim 2 wherein said selected saturated fatty acid soaps (myristic, stearic, and palmitic acid soap) level is from about 20% to about 50% by weight of said bar; and wherein said nonreducing sugar is from about 5% to about 20%; and said hydrophobic/lipophilic material is from about 2% to about 25%; and said water is from about 20% to about 25% by weight of said bar; and wherein said bar contains from about 10% to about 20% of said selected lauric/oleic acid soaps by weight of the said bar.

6. The mild, lathering freezer soap bar of claim 5 wherein said bar contains from about 4% to about 30% of a mild lathering synthetic surfactant.

7. The mild, lathering freezer soap bar of claim 1 wherein said freezer soap bar comprises by weight of said bar: from about 30% to about 55% of said total fatty acid soap; and wherein said oleic acid soap is primarily cis.

8. The mild, lathering freezer soap bar of claim 2 wherein said freezer soap bar comprises by weight of said bar:

from about 30% to about 55% of said total fatty acid soap;

from about 5% to about 20% of said nonreducing sugar; from about 5% to about 20% of said hydrophobic/lipophilic material; and from about 20% to about 25% of said water; and wherein lauric and oleic soap level is from about 12% to about 18% by weight of the said bar.

9. The freezer mild, lathering freezer soap bar of claim 1 wherein said soap bar comprises by weight of said bar;

from about 30% to about 55% of said total fatty acid soap;

from about 5% to about 20% of said nonreducing sugar;

from about 5% to about 20% of said hydrophobic/-lipophilic material; and from about 20% to about 25% of said water; and wherein said oleic soap cis/trans isomer ratio is from about 1:0 to about 20:1.

10. A process for making a freezer bar comprising the following steps:

I. Mixing a soap composition comprising:

A. saturated fatty acid soaps selected from the group consisting of: myristic, palmitic, and stearic acid soaps and mixtures thereof at a level of from about 65% to about 85% by weight of total fatty acid soap; and B. from about 15% to about 35% of soap selected from the group consisting of: oleic and lauric acid soaps and minor ($C_8$, $C_{10}$, $C_{18:2}$) fatty acid soap selected from the group consisting essentially of: $C_8$, $C_{10}$, $C_{18:2}$ and mixtures thereof;

wherein said bar contains from about 8% to about 25% of said selected oleic and lauric soap, and minor ($C_8$, $C_{10}$, $C_{18:2}$) soaps;

wherein said oleic soap level is from 0% to about 25% by weight of the bar; and wherein said lauric soap is from 0% to about 10% by weight of said bar; and wherein said minor ($C_8$, $C_{10}$, $C_{18:2}$) soap level is from 0% to about 5% by weight of said bar; and wherein said selected lauric/oleic soap to said minor ($C_8$, $C_{10}$, $C_{18:2}$) soap have a ratio of from about 1:1 to about 1:0; and wherein said soap is a mixture of sodium and potassium soap (Na/K); and wherein said Na/K soap mixture level is from about 90% to about 100% by weight of said total soap; and wherein said Na/K soap has a ratio of from about 19:1 (95/5) to about 1.5:1 (60/40); and wherein said freezer soap bar comprises from about 30% to about 70% of total fatty acid soap by weight of said bar; and CV. from about 15% to about 30% of water by weight of said bar;

wherein said fatty acid soap and other soap ingredients are mixed at a temperature of from about 65° C. to about 74° C. (from about 150° F. to about 165° F.);

wherein said soap is made in situ at an initial temperature of from about 52° C. to about 57° C. (125°-135° F.) and a final temperature of from about 85° C. to about 99° C. (185°-210° F.); said other soap ingredients are added;

II. Cooling the mix of Step I. to crystallize said mix from a temperature of from about 85° C. to about 99° C. (from about 175° F. to about 210° F.) to a final temperature of from about 46° C. to about 66° C. (115°-155° F.); and III. Extruding the cooled mix of Step II. onto a cooling belt to finish crystallization and form bars (plugs).

11. The process of claim 10 wherein from about 5% to about 30% of sucrose is added in Step I.

12. The process of claim 10 wherein said mix of Step I. is aerated before cooling.

* * * * *